US005138810A

United States Patent [19]

Kartler

[11] Patent Number: 5,138,810

[45] Date of Patent: Aug. 18, 1992

[54] CORNERAIDE DEVICE AND METHOD

[75] Inventor: David Kartler, Mission Viejo, Calif.

[73] Assignee: Thomas P. Mahoney, Newport Beach, Calif.

[21] Appl. No.: 526,519

[22] Filed: Aug. 3, 1990

[51] Int. Cl.[5] ..... E04G 11/00

[52] U.S. Cl. ..... 52/254; 52/288; 52/287; 52/280; 52/255

[58] Field of Search ..... 52/254–257, 52/287–288, 716, 280, 81

[56] References Cited

U.S. PATENT DOCUMENTS

| | | | |
|---|---|---|---|
| 462,164 | 10/1891 | Rockwell | 52/288 |
| 1,315,260 | 9/1919 | Tischler et al. | 52/288 |
| 1,789,102 | 1/1931 | Jorgensen | 52/280 |
| 1,919,300 | 7/1933 | Lewis | 52/287 |
| 3,175,330 | 3/1965 | Holsman | 52/255 |
| 3,255,561 | 6/1966 | Cable | 52/288 X |
| 3,391,509 | 7/1968 | Fruman | 52/255 X |

*Primary Examiner*—David A. Scherbel
*Assistant Examiner*—Wynn E. Wood
*Attorney, Agent, or Firm*—J. Mark Holland; Thomas P. Mahoney

[57] ABSTRACT

A corneraide device is provided for finishing joints at the intersection of two or more surfaces. The corneraide includes a substantially planar central web with bead members along the edges thereof. Operatively associated with the bead members and extending therefrom are flange members adapted for alignment with the two or more surfaces. Joint compound, wallboard mud, stucco or some similar formable finishing or coating material is applied over the flange members and fayed from the bead members over the respective flange members to the respective surfaces. The corneraide of the invention permits ready alignment on the intersection and efficient application of finishing material thereon. Various embodiments and adaptations of the invention may be utilized to finish arches, window corners, exposed three-way corners, and other structures.

16 Claims, 5 Drawing Sheets

CORNERAIDE DEVICE AND METHOD

This invention relates to devices and methods for finishing a joint at the intersection of two or more surfaces in a building or similar structure, and specifically relates to an improved corneraide construction for that purpose. The corneraide of the invention is characterized by an elongated body having a substantially planar central web, with bead means and flange members associated with respective edges thereof, whereby the flange members may be operatively aligned with the respective surfaces forming the intersection and the central web means disposed over said intersection. The substantially planar central web and the bead means associated therewith permit a formable finishing material such as joint compound or stucco to be readily applied over said flange members in a more efficient manner than previously achievable.

BACKGROUND OF THE INVENTION

To provide a smooth finish on corners and other intersections of interior and exterior surfaces of buildings and similar structures, it is known to attach a metal or plastic elongated strip along the intersection and to utilize the strip as a guide and support for applying joint compound, stucco or the like. The joint compound may be readily manipulated and formed when wet, and is applied to the strip and the surfaces with various tools (such as trowels, for example) to provide a smooth, asthetically pleasing, finished surface at the corner.

For a number of reasons, substantial skill is required to apply the joint compound in an efficient manner. First, the compound can only be manipulated while it is wet or semi-liquid, and it often dries in a relatively short time span. Second, because it must be applied in its semi-liquid, relatively easily formable state, it is difficult to precisely limit the area of application of the compound. As a result, compound material tends to overflow or spatter onto surfaces adjacent the desired area of application, including other areas of the corneraide strip. If such excess material is not removed or wiped off while in its semi-liquid state, it will harden and must subsequently be removed by sanding or some similarly slow, energy-intensive action.

Thus, it is desirable to provide a corneraide guide which enables stucco or other finishing material to be applied quickly and smoothly and formed into the desired finished shape, while also permitting ready clean-up of any excess finishing material which is inadvertently or unavoidably spattered onto adjacent surfaces. The corneraide of the invention provides substantial improvements over the prior art in this regard.

The cross-sectional configurations of prior art corneraide devices involve inherent shortcomings in connection with the aforementioned criteria. For example, constructions such as U.S. Pat. No. 3,109,207 to Cooper incorporate a basically perpendicular cross-section to cover the intersection of two surfaces. Although smooth finished surfaces and corners may be achieved through the use of such cross-sectional shapes, they incorporate numerous inadequacies.

When joint compound is applied over one of the flange portions of Cooper on one of the surfaces forming the intersection, excess compound tends to spill over onto the other flange portion and surface. Normally, compound is applied to the first flange adjacent the corner bead and subsequently to the adjacent wall surface. The two deposit areas are then fayed and blended into each other to form a smooth surface terminating at the bead.

This "overspill" phenomena also occurs when the compound is subsequently applied to the second flange portion and surface. Unless the person applying the compound has the luxury of being able to allow the first surface to dry before beginning to work on the second surface, the compound on the first surface will still be soft when additional compound is applied to the second surface. Any excess compound from that second-surface application which contacts the still-soft compound on the first surface may mar or otherwise damage the soft areas of the compound on the first surface.

In addition, and as indicated above, it is common to apply the aforesaid joint compound or stucco with a trowel or similar expedient. Moreover, it is common to utilize the trowel for other purposes, including cleaning the excess compound from adjacent surfaces. When employing the edge of a trowel or similar applicator to remove any excess material from the Cooper corneraide, however, great care must be taken to avoid nicking or otherwise denting the exposed corner of the corneraide. Frequently, the necessarily honed edge of the trowel will cut into the corner, requiring remedial measures to achieve the desired smooth finish.

Furthermore, the gypsum wallboard or other surfaces to be finished frequently includes some unintentional non-planar deviations or curvature therein (commonly caused by the non-planarity of the supporting studs or other wall structure), which can be especially noticeable at exposed corners and other intersections where corneraide devices are employed. Corneraides of a construction similar to Cooper have little inherent rigidity with which to maintain a desired linear alignment along the intersection and to so provide an operable guide for finishing the joint. Instead, Cooper-type constructions tend to waver and follow any deviations in the respective surfaces of the intersection. Accordingly, the application of joint compound to the Cooper corneraide also tracks any such undesirable deviations.

Another prior art construction of increasing popularity is known as bull-nose corneraide. It incorporates flangellate portions along each surface of the intersection, similar to Cooper, but also includes a curved intermediate portion along the length of the corneraide, whereby the intersection of the surfaces may be provided with a curved transition from one surface to the other. Even though recently achieving popularity due to its relatively new and modernistic shape, it suffers from many of the same shortcomings as does the Cooper corner strip.

Among other things, it is relatively difficult to remove excess joint compound from the bull-nose curved surface. Even skilled workers utilizing specially designed tools must employ two cleaning passes (one for each surface) to accomplish the necessary cleaning. Those less skilled or without the aforementioned special tools frequently utilize rags or their hands to clean the curvilinear intermediate portion.

In addition, the curvilinear cross-section of bull-nose corneraide requires a substantial backside clearance; that is, the supporting materials which form the intersecting surfaces cannot approach one another too closely or they will contact the curved intermediate portion of the bull-nose corneraide and prevent the operative juxtaposition of the flangellate portions thereof with the intersecting surfaces. Although the necessary clearance may be provided without excessive effort in new structures, it can require extensive labor to "cut-back" corners of existing structures for purposes of remodeling with the bull-nose configuration.

Another difficulty in utilizing the bull-nose construction occurs at the top and particularly the bottom ends of the corners. In many interior environments, a molding, baseboard or similar structure is affixed to walls along the top and/or bottom edges thereof. These moldings and baseboards are typically fabricated from wood or a similarly inflexible material. For standard angular (non-bull-nose) corners, the baseboard material may be readily mitered at an appropriate angle to achieve a smooth transition around the corner.

For bull-nose corners, however, such mitering cannot accomplish the curvature (non-linearity) necessary to approximate the curvature of the bull-nose corner lying therebehind. As a result, unsightly gaps exist at at least some areas between the baseboard and the bull-nose when standard baseboard is utilized.

Furthermore, the exposed curvilinear bull-nose corner is particularly susceptible to denting from ordinary pedestrian traffic and general wear and tear in various environments. Such denting may also occur during the original construction activities during and subsequent to the installation of the bull-nose device. Repairs for such dents are typically made by applying joint compound to the curved surface and shaping and sanding same to achieve the appropriate curvature. Such repairs involve substantial time to effectuate, and the "filler" of compound is prone to "popping out" upon subsequent contact with the bull-nose.

Yet another difficulty with bull-nose corneraide is that its curved surface tends to flatten when the corneraide is cut to an desired length. Tin snips ar typically utilized to cut metallic corneraide. When cutting metal bull-nose corneraide, because of the light-weight metal's lack of "memory" (it does not tend to return to its desired curved cross-sectional configuration), the metal must be reshaped by hand in the area adjacent the cut so that it will approximate the desired curvature.

OBJECTS AND ADVANTAGES OF THE INVENTION

It is, therefore, an object of my invention to provide a corneraide device which overcomes the aforedescribed deficiencies and is characterized as having an elongated body including a substantially planar central web with bead means along the edges thereof and flange members associated with said bead means, whereby the flange members may be operatively aligned on intersecting surfaces resulting in the disposition of the central web over the intersection. A formable coating means may be fayed from the respective bead means across the respective flange members to a corresponding surface to provide a smooth finished surface.

The provision of the planar central web and said bead means permits, among other things, the application of the formable coating means such as joint compound to be achieved in a much more efficient manner than previously possible. The joint compound may be applied in a normal manner to one flange member between its corresponding surface and bead means, and then to the other flange member between its corresponding surface and bead means. Because of the width of the central planar web means, splattering of the joint compound adjacent the respective bead means occurs on the central planar web means rather than on the opposite flange member or intersecting surface. Also because of the width of the central planar web means, such splattering may be readily removed in a single pass with little risk of damaging the smooth surface of the web means or either of the fayed joint compound coverings over the flange members.

In addition, the inherent rigidity of the cross-section of the corneraide of my invention improves the alignment of the corneraide and the linearity of the joints achievable therewith.

Another object of my invention is to provide a device of the aforementioned character in which the flange members include attachment means for retaining the elongated body in operative position with said intersecting surfaces.

Yet another object of my invention is to provide an embodiment of the device of the aforementioned character in which is adapted for use at the intersection of three surfaces. Such an embodiment is characterized by a substantially planar, triangular face and first, second, and third elongated web means extending from the respective edges of the triangular face. Depending on the application, two or more of the elongated web means may incorporate crosssectional shapes including a substantially planar central portion configured to overlie the straight or curvilinear lines formed by the intersection of respective pairs of the first, second, and third surfaces.

In the triangular-faced embodiment, flange members and bead means similar to those discussed above may be provided in operative association with the planar central portions to permit alignment and retention on said surfaces. In the preferred assembly, the elongated web means are adapted to cooperatively align and engage with elongated devices of the aforementioned character; that is, those devices fabricated to finish the joint at the intersection of the respective pair of surfaces.

Other objects and advantages of the invention will be apparent from the following specification and the accompanying drawings, which are for the purpose of illustration only.

DESCRIPTION OF PREFERRED EMBODIMENT

Figure 6:
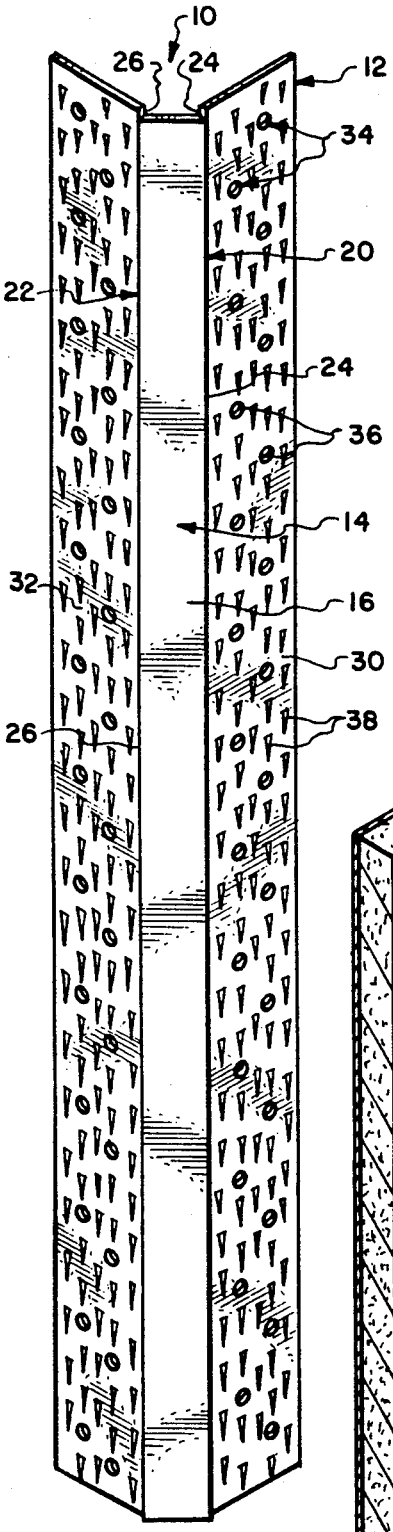
FIG. 6 is an isometric view of a preferred embodiment of the corneraide of my invention, such as that illustrated in FIGS. 1-4 and 8.
Figure 9:
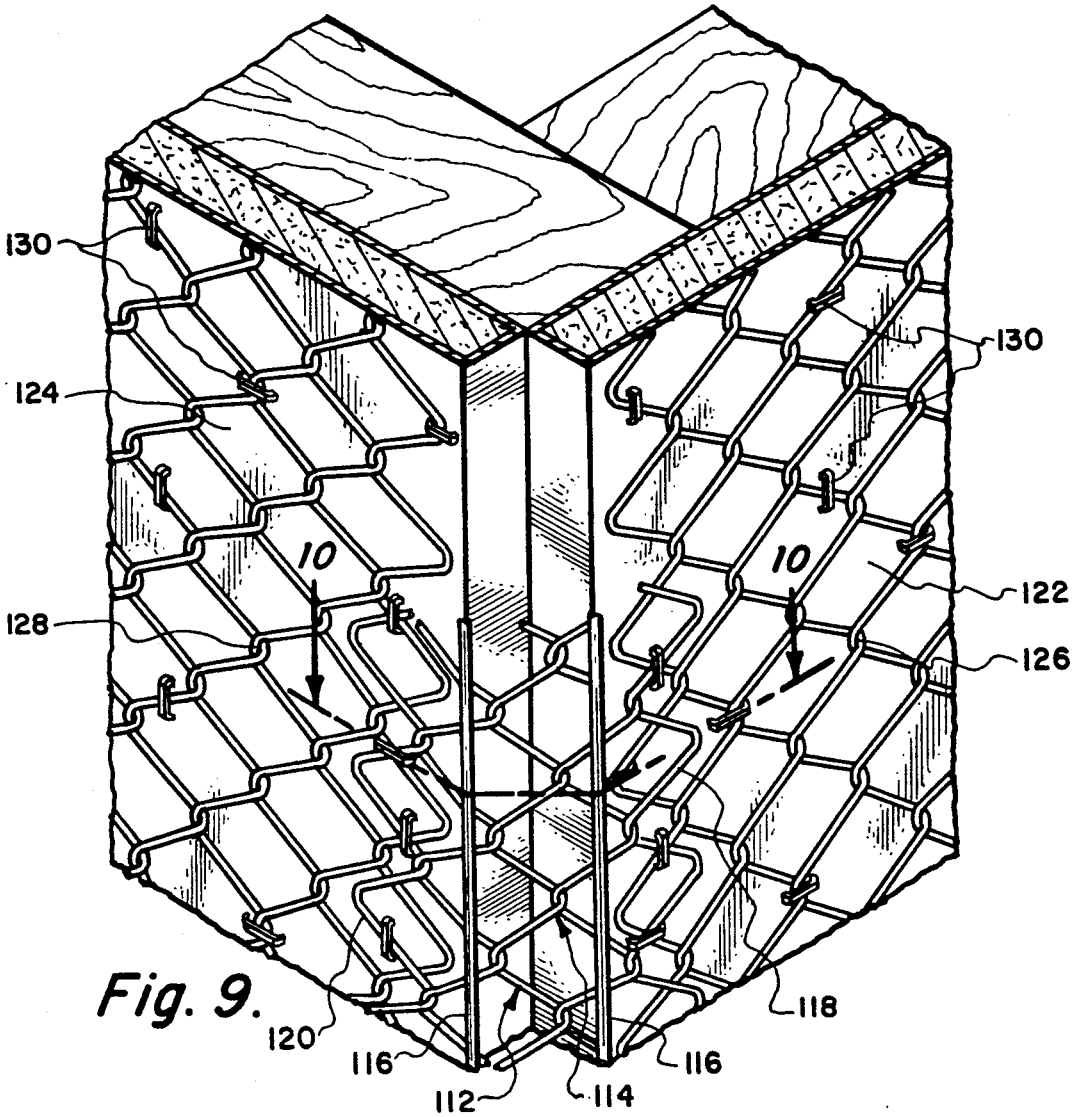
FIG. 9 is a fragmentary sectional view of an alternative embodiment of a corneraide construction fabricated in accordance with the teachings of my invention in operative assembly with two intersecting surfaces and adapted for utilization with stucco finishing material.
Figure 10:
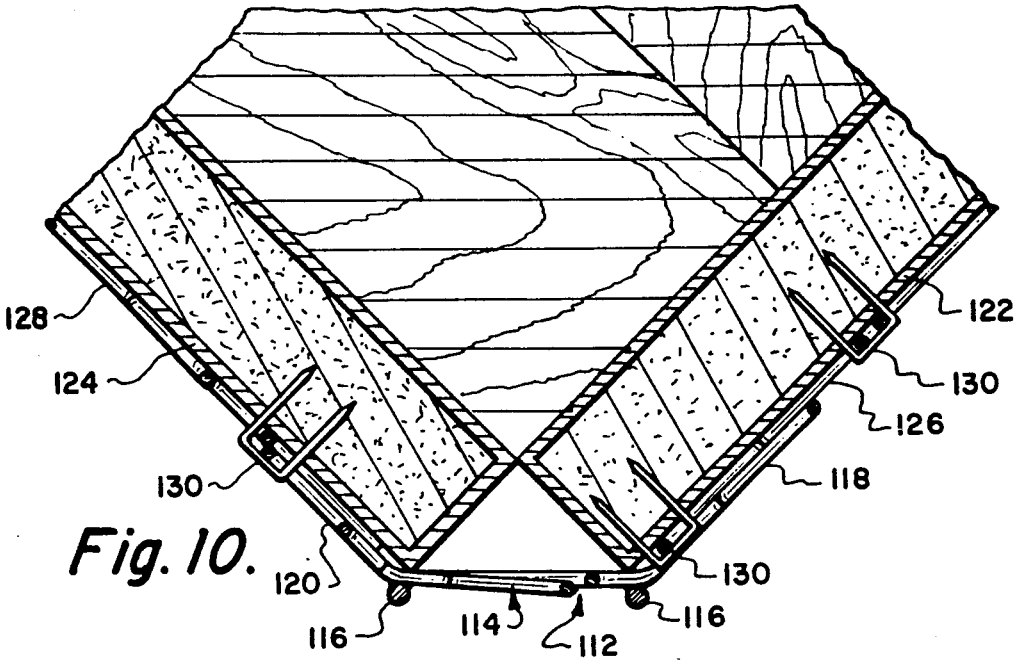
FIG. 10 is a fragmentary sectional plan view, taken along line 10—10 of FIG. 9.
Figure 11:
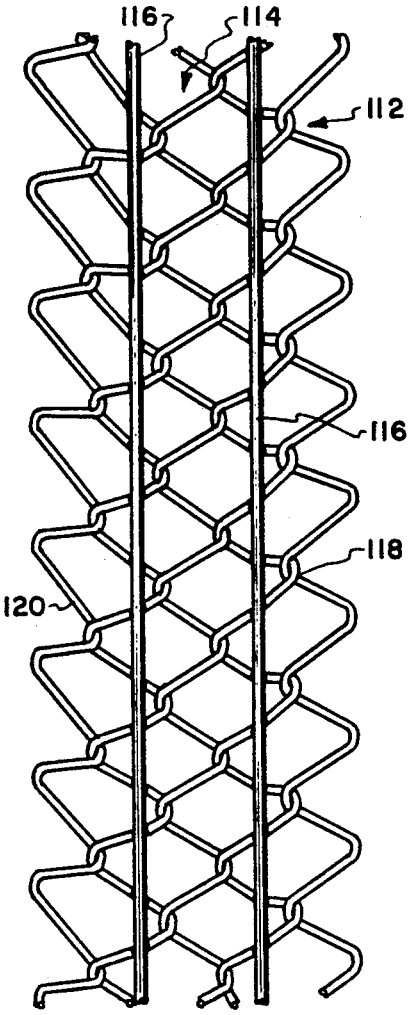
FIG. 11 is an isometric view of the alternative embodiment of the corneraide of my invention illustrated in FIGS. 9 and 10.

Referring to the drawings, and particularly to FIG. 6 thereof, I show a preferred embodiment of a corneraide device 10 as elongated body member 12 constructed in accordance with the teachings of my invention. The device 10 is preferably roll-formed or break-formed from light-gauge metal or molded from plastic, but may be fabricated in any suitable manner from any of a range of materials. One example of the many alternative embodiments of my invention is illustrated in FIGS. 9-11, and will be described more thoroughly below.

The elongated member 12, FIG. 6, includes substantially planar central web means 14 such as web portion 16. Bead means 20 and 22 such as beads 24 and 26 define the edges of the central web means 14 and are operatively associated therewith.

In the preferred embodiment of FIG. 6, such operative association is accomplished by integral formation of said bead means with said web means 14. As will be obvious to those skilled in the art, however, the requisite association may be accomplished in a variety of ways, including, for example, that shown in the alternative embodiment of FIG. 11, in which wires are tack welded at the edges of the central web (as will be more fully described below).

As further illustrated in FIG. 6, the preferred embodiment includes flange members or attachment members 30 and 32 operatively attached to the respective bead means 20 and 22 and extending therefrom. The flange members 30 and 32 preferably include attachment means 34 such as holes 36 therealong configured to cooperatively receive nails, screws or the like to retain the device 10 in alignment on selected surfaces, as more thoroughly described below.

In addition, the preferred embodiment of FIG. 6 includes scoring or embossing 38 along the length of the flange members, for purposes which will be described hereinbelow.

Figure 1:
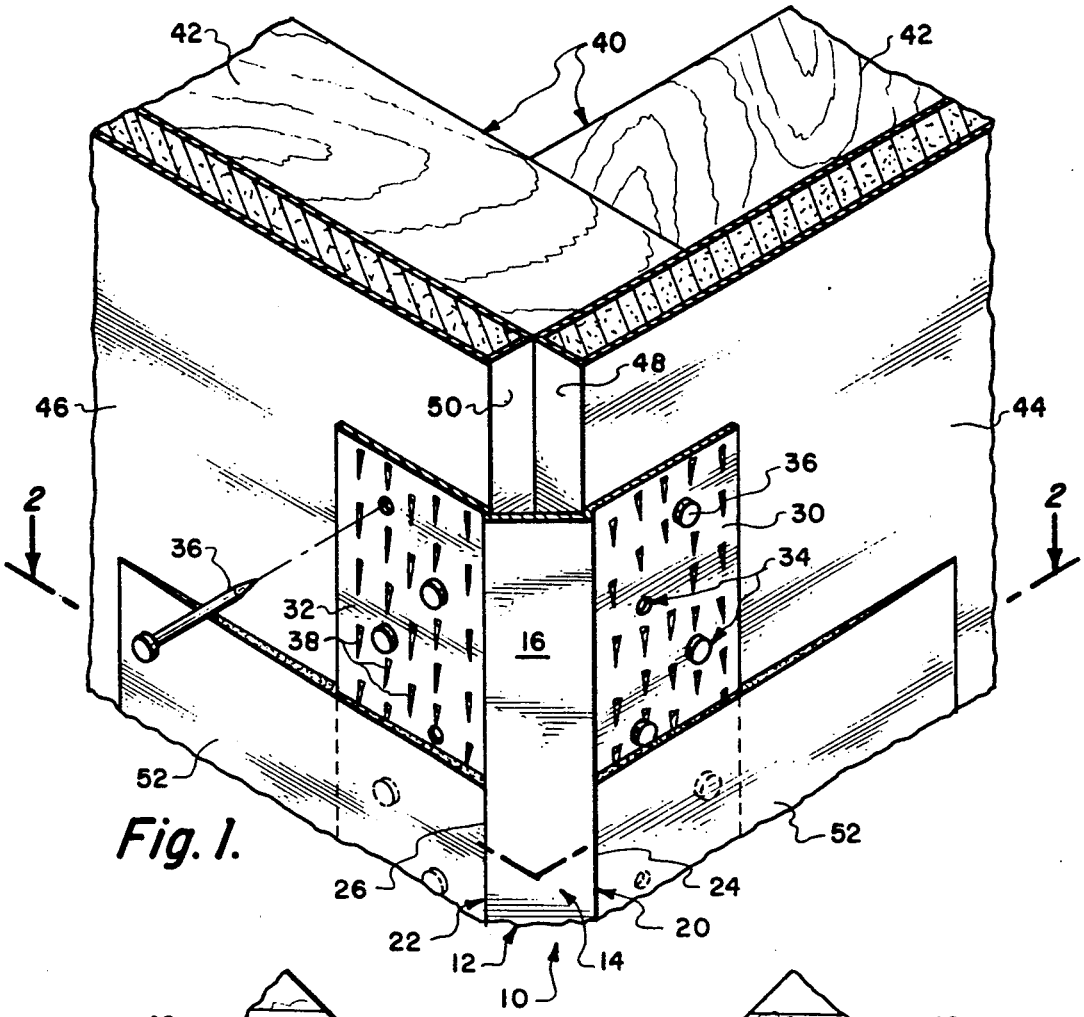
FIG. 1 is a fragmentary sectional view of a preferred embodiment of a corneraide construction in operative assembly with first and second intersecting surfaces, all in accordance with the teachings of my invention.
Figure 2:
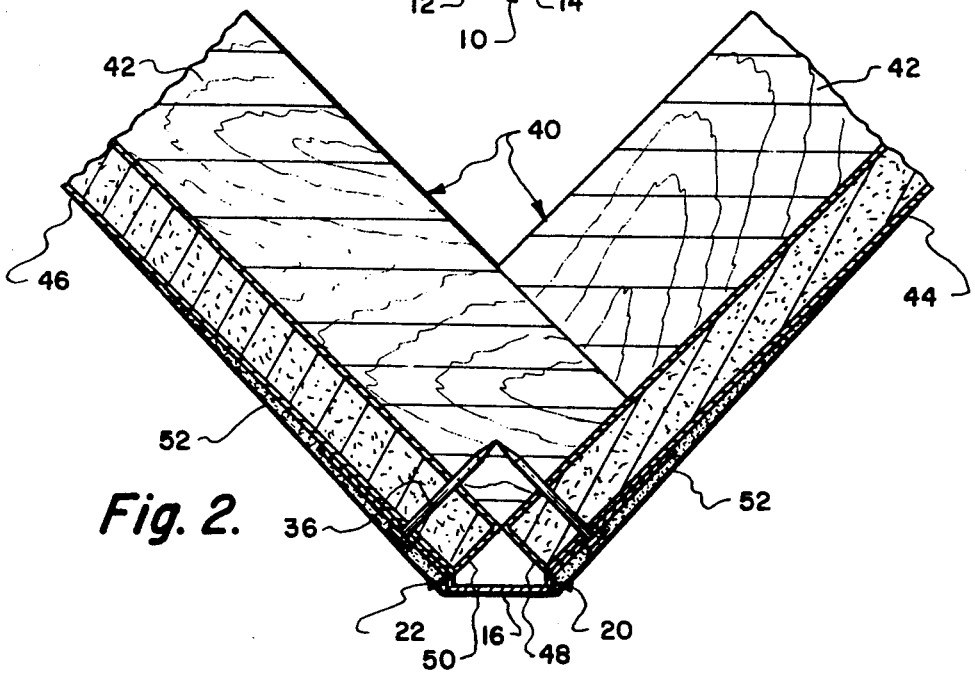
FIG. 2 is a fragmentary sectional plan view, taken along line 2—2 of FIG. 1.

Turning now to FIGS. 1 and 2, a preferred application of the corneraide of my invention is illustrated and includes wall-supporting means 40 such as stud walls 42. Operatively attached to the stud walls 42 are sheets of wallboard, gypsumboard, or other covering material providing a first surface 44 and a second surface 46, and having respective edge faces 48 and 50.

The first and second surfaces 44 and 46 are described herein as "intersecting" surfaces, although they do not literally intersect because of the contiguous rather than overlapping relationship of the edge faces 48 and 50. Utilization of the corneraide of my invention achieves a smooth finished corner joint at the "intersection" of these two surfaces 44 and 46.

With respect to the spatial interrelationship of the edge faces 48 and 50, those skilled in the art will understand that the only limiting aspect of that relationship is that the edges must be sufficiently distant from one another to permit the operative alignment of the corneraide device 10 with the surfaces 44 and 46, as described herein.

In the preferred embodiment, the elongated member 12 is utilized by placing it in operative relationship wit the surfaces 44 and 46. In particular, the flange members 30 and 32 are intimately juxtaposed in confronting parallel relationship with the respective surfaces 44 and 46. The preferred juxtaposition aligns the web means 14 and its corresponding respective bead means 20 and 22 along the line of intersection of the surfaces 44 and 46.

The corneraide device 10 is then preferably operably attached to the surfaces 44 and 46 through the use of attachment means 34 such as cooperating nails and holes 36. Those skilled in the art will understand that a broad range of expedients may be employed to accomplish the desired attachment and retention of the corneraide on the surfaces 44 and 46, including, without limitation, screws, adhesive bonding, or crimping or deformation of the flange members into the surfaces 44 and 46.

To achieve the desirable smooth finished surfaces at the corner joint, a formable coating or finishing means 52 such as joint compound, wallboard mud, stucco or the like is applied over the flange members 30 and 32 with a trowel or similar expedient. The trowel (not shown) preferably includes a straight narrow edge thereon of a length appropriate to fay or smooth the coating means 52 from the respective corresponding surfaces 44 and 46 to the bead means 20 and 22 in a tapering manner.

As indicated above, it is not uncommon for the coating means 52 to be inadvertently splattered onto adjacent surfaces during the application process. In the preferred embodiment of my invention, the relevant splattering accumulates on the central web member 16 of the corneraide. The width of the central web member is such that, in comparison with prior art structures such as Cooper, the device of my invention reduces or eliminates any splattering on the opposite intersecting surface.

For example, while applying the wallboard mud 52 to the flange member 30 and the underlying surface 44 in FIG. 1, splatters of the mud may land on the web 16, but little or no mud will be splattered onto the opposite flange member 32 or the opposite intersecting surface 46.

As those skilled in the art will appreciate, the splattering on the web 16 may be readily cleaned off by a single pass of, for example, the aforementioned edge of the applicator trowel. In this mode, the trowel is utilized to remove the splattering rather than to apply mud to the joint. In a preferred method of utilizing the corneraide of my invention, joint compound is applied first to flange member 30 and its underlying surface 44, and then to flange member 32 and its underlying surface 46 (or vice versa). The straight edge of the trowel is then scraped along the substantially planar web 16 and, in a single pass, removes any splattering which occurred from applying the mud to either surface 44 or 46.

The central web means 14 is sufficiently wide to reduce or eliminate the likelihood of gouging or denting the device 10 during the removal of any splattering, which gouging can be a problem prior art structures such as Cooper.

The finishing means 52 preferably sets or hardens with the passage of time and loses its malleability, thereby providing a finished surface for the joint which smoothly tapers from the first surface 44 across the exposed surface of the coating 52 to the bead member 24. A similarly smooth finished surface is achieved on the opposing intersecting surface 46. The disposition of the web means 14 therebetween completes the aesthetically pleasing, smooth finished corner joint.

Figure 14:
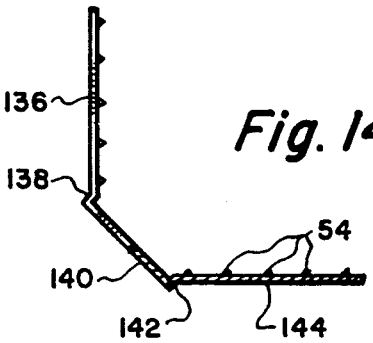
FIG. 14 is a sectional view, taken along line 14—14 of FIG. 12.
Figure 15:
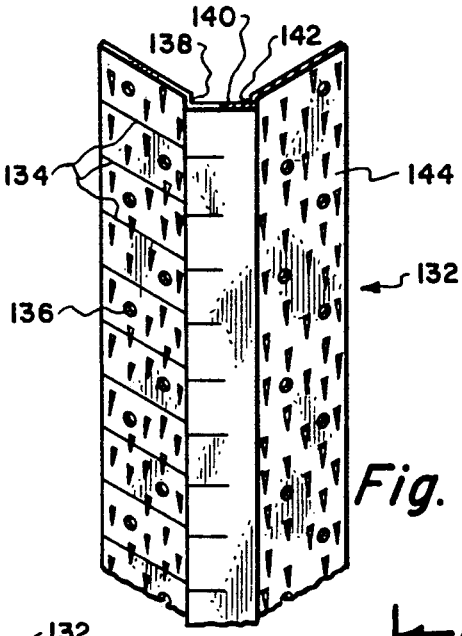
FIG. 15 is an isometric view of the alternative embodiment of the corneraide of my invention illustrated in FIGS. 12-14.
Figure 12:
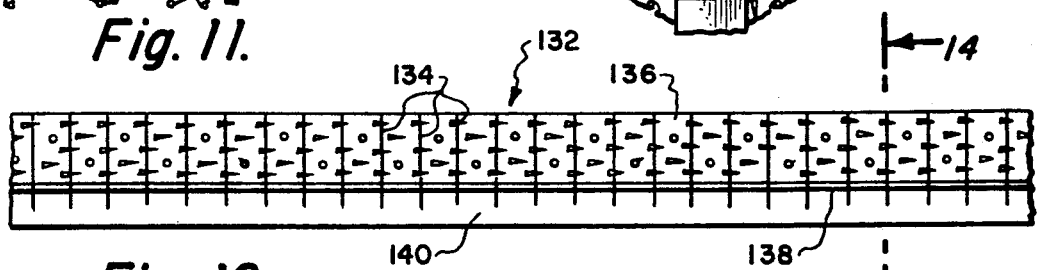
FIG. 12 is a fragmentary elevational view of another alternative embodiment of my invention which has been adapted for use in connection with archways or other curved surfaces.

Those skilled in the art will understand that the embossing 38 on the flange members 30 and 32 provides improved adherence of the hardened compound 52 to the flange members, and that any corresponding protrusions on the inner side of the flanges, such as the protrusions 54 in FIG. 14 enhance the adherence of the device 10 to the surfaces 44 and 46. Similarly, any unused holes 36, as well as the nailheads 36, on the flange members 30 and 32 improve the retention and adherence of the hardened compound on the flanges, and help to reduce the likelihood of dislodgement of same from the flanges or wall surfaces 44 and 46 due to contact therewith of ordinary pedestrian traffic and wear and tear.

In that regard, the corneraide of my invention provides a somewhat recessed profile in comparison to prior art devices, thus reducing the likelihood of inadvertent and potentially harmful contact therewith by passing pedestrians.

Persons skilled in the art will also understand that paint or wallpaper may be applied over the finished smooth joint and, in particular, may be applied directly to the web portion 16 and the hardened compound 52. In addition, wallboard tape may be utilized and incorporated in the application of the compound 52 to provide additional strength and crack-resistance to the compound 52.

Furthermore, the web portion 16 may be anodized, treated with an appropriate metal coating, polished or otherwise manufactured to have a desirable finish which does not require paint, wallpaper, or other covering. In such an embodiment, the device 10 may be provided with masking tape or other protective strip means (not shown) covering the web-portion 16. After installation of the corneraide, including application and hardening of the compound 52 and any painting or wallpapering of surfaces adjacent the corneraide, the protective strip means is removed to expose the attractive, lustrous surface of the web portion 16. No further treatment of the corner is necessary in this embodiment.

Moreover, it will be obvious to those skilled in the art that the corneraide device of my invention may be utilized in applications where the intersecting surfaces 44 and 46 are in a non-perpendicular relationship with each other. In such applications, the flange members 30 and 32 are formed to align in respective parallel relationships with the corresponding intersecting surfaces.

Figure 3:
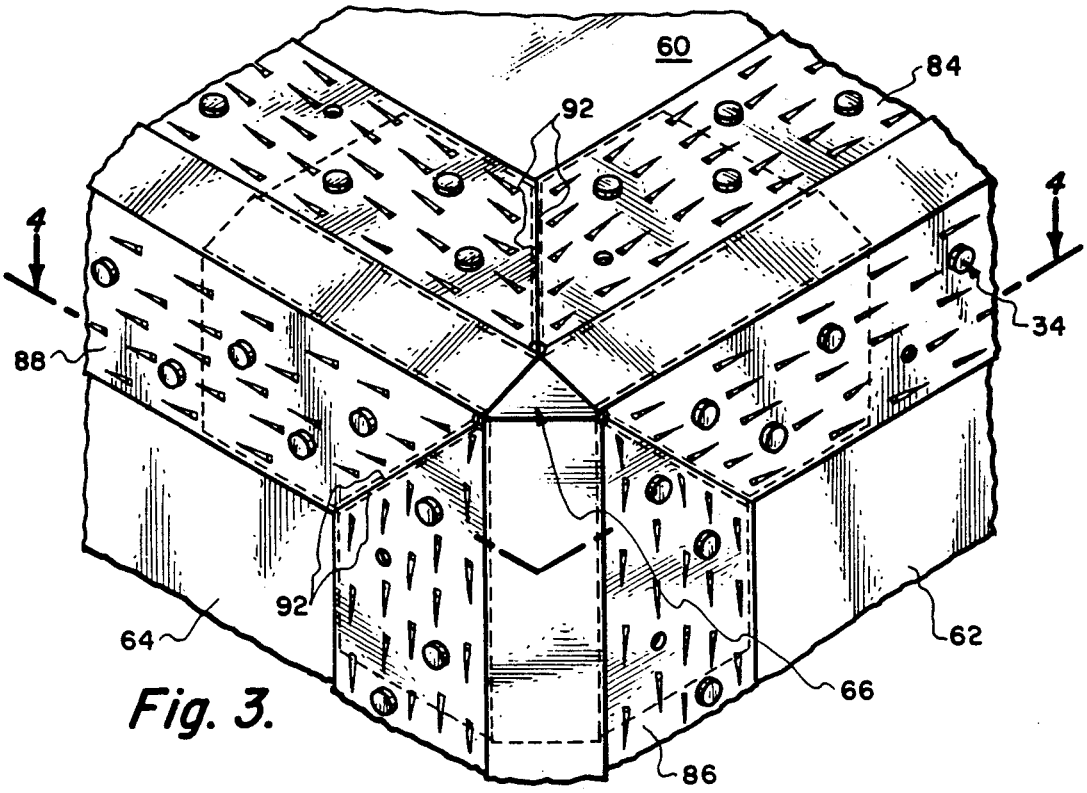
FIG. 3 is a fragmentary view of a corneraide construction fabricated in accordance with the teachings of my invention in operative assembly with three intersecting surfaces.
Figure 4:
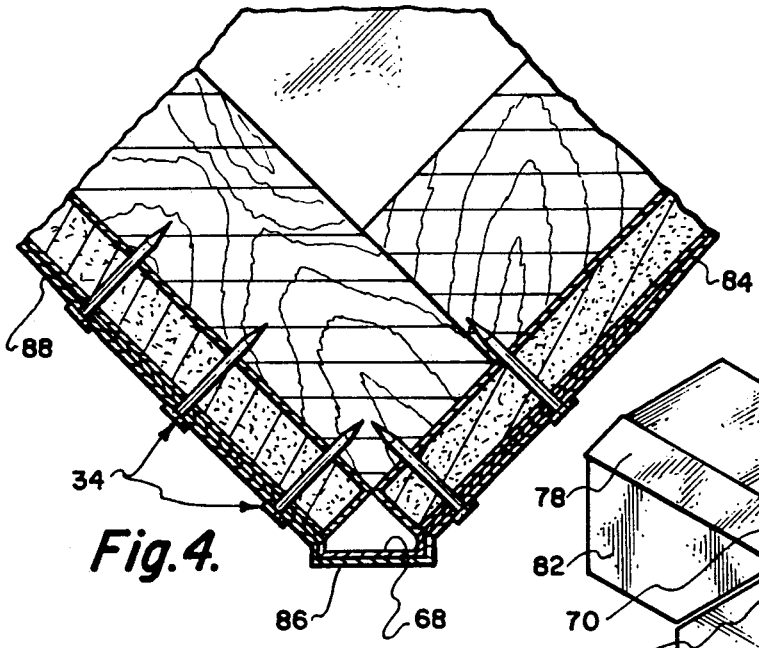
FIG. 4 is a fragmentary sectional plan view, taken along line 4—4 of FIG. 3.
Figure 5:
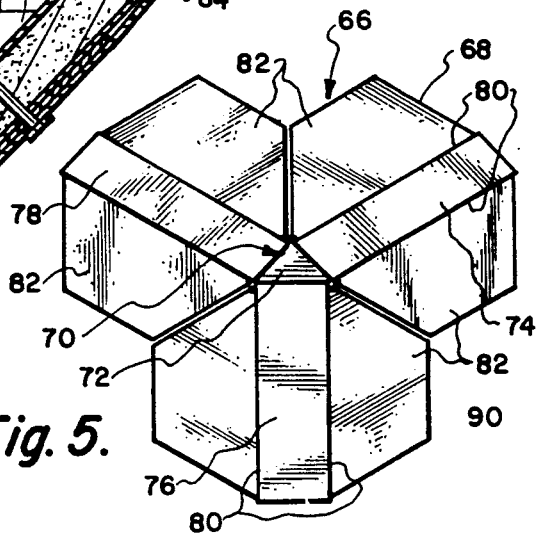
FIG. 5 is an isometric view of the cap device illustrated in FIGS. 3 and 4.

Other embodiments and applications of my invention are illustrated in FIGS. 3–5 and 7–15. In FIGS. 3–5, a preferred construction of an alternative embodiment of my invention is provided which is useful for finishing joints at the intersection of three, as opposed to the heretofore described two, surfaces.

In FIG. 3, intersecting surfaces 60, 62 and 64 (similar to surfaces 44 and 46 of FIG. 1) form a three-way exposed corner. Such structures occur, for example, on half-walls, fir-downs from which cabinets are hung, and the like.

As an alternative to simply mitering the ends of three of the corneraide devices 10 described above so as to form a point at the exposed corner, a capping device 66 such as cap member 68 is provided. The cap member 68 preferably is fabricated from materials similar to those utilized for the corneraide device 10, and preferably includes a central hub means 70 having a triangular, substantially planar face 72. Operatively attached to each of the three respective edges of the triangular face 72 or integrally formed therewith are first, second, and third web means 74, 76, and 78.

The web means 74, 76, and 78 preferably include bead means 80 and flange means 82 corresponding to the bead means 20 and 22 and flange members 20 and 32 of the embodiment of FIG. 6. In the preferred assembly of the cap member 68 on the surfaces 60, 62, and 64, the flange means 82 of cap 68 are juxtaposed in operative confronting parallel relationships with the respective surfaces 60, 62, and 64. Such operative relationship includes the alignment of the web means 74, 76, and 78 along the three straight lines formed by the intersection of respective pairs of the first, second and third surfaces 60, 62, and 64.

To be more precise, referring to FIGS. 3 and 5, web means 74 is aligned with the intersection of surfaces 60 and 62, web means 76 is aligned with the intersection of surfaces 62 and 64, and web means 78 is aligned with the intersection of surfaces 64 and 60.

Although the preferred embodiment of the cap member 68 does not include attachment holes or scoring on the flange means 82, such may be provided as an obvious modification thereto. Retention of the preferred embodiment is instead achieved initially by driving a nail (not shown) or similar expedient into one or more of the surfaces 60, 62 and 64, adjacent the appropriately-aligned cap member 68 so that the a portion of the head of the nail overlies the edge of the flange means 82.

Subsequent and more permanent retention of the cap member is achieved by placing first, second and third corner constructions 84, 86 and 88 such as corneraide devices 10, FIG. 6, in overlying relationship over the corresponding web means 74, 76 and 78 in operative alignment with the aforementioned respective intersections of respective pairs of the first, second and third surfaces 60, 62, and 64.

As an alternative method of covering the three-way exposed corner, one of the first, second or third corner constructions 84, 86 or 88 may be operatively attached (as described above) along its respective intersection of a pair of the first, second and third surfaces 60, 62, and 64, but leaving the end of the corner construction which is adjacent the three-way exposed corner unattached to the relevant surfaces. One of the web means 74, 76, or 78 of the capping device 66 may be operatively disposed between the relevant surfaces and the corner construction. The capping device is then brought into operative alignment along the other two intersections of pairs of the first, second and third surfaces 60, 62, and 64, and the other corner constructions 84, 86 or 88 are operatively disposed in overlying relationship with the cap member 68, as described above.

The corner constructions 84, 86 and 88 are cut or otherwise configured at their ends adjacent the capping device 66 so that the relevant ends of the central web means 14 of each of the constructions 84, 86, and 88 overlie the respective web means 74, 76 and 78 and abut the respective edges of the triangular hub means 70. In that regard, the edges of the triangular hub means 70 are preferably provided with hub edge bead means 90 to space the edges of the hub means above the web means 74, 76, and 78 so that, when the constructions 84, 86, and 88 overlie the respective web means 74, 76 and 78, the triangular face 72 is in approximate alignment therewith along their adjacent edges In addition, the ends of the flange members 30 and 32 of the respective constructions 84, 86, and 88 that are adjacent the cap member 68 are cut or otherwise fabricated with appropriately mitered ends 92, so that operative assembly of the constructions 84, 86, and 88 on the capping device 70 results in a coplanar alignment of the respective corresponding flange members 30 and 32 on each of the surfaces 60, 62 and 64.

Although attachment means such as nails 34 are shown in FIG. 3 as utilized by driving the nails through the flange means 82, such nailing in this area is not required 20 and sufficient retentive force may be achieved simply by the utilization of attachment means 34 on the corner constructions 84, 86, and 88 adjacent the cap member 68.

As will be obvious to those skilled in the art, formable coating means such as coating means 52, FIG. 1, may be applied in a similar manner to that described above, to achieve a desirable, smoothly finished, three-way corner.

Figure 7:
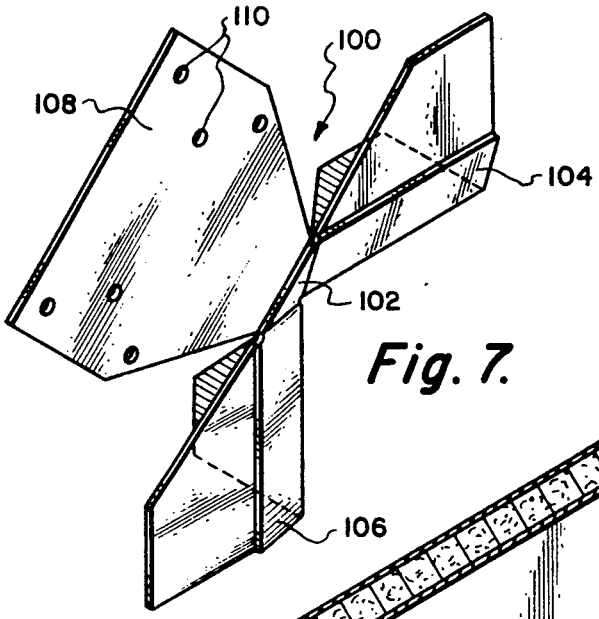
FIG. 7 is an isometric view of another embodiment of a cap device similar to that shown in FIG. 5.
Figure 8:
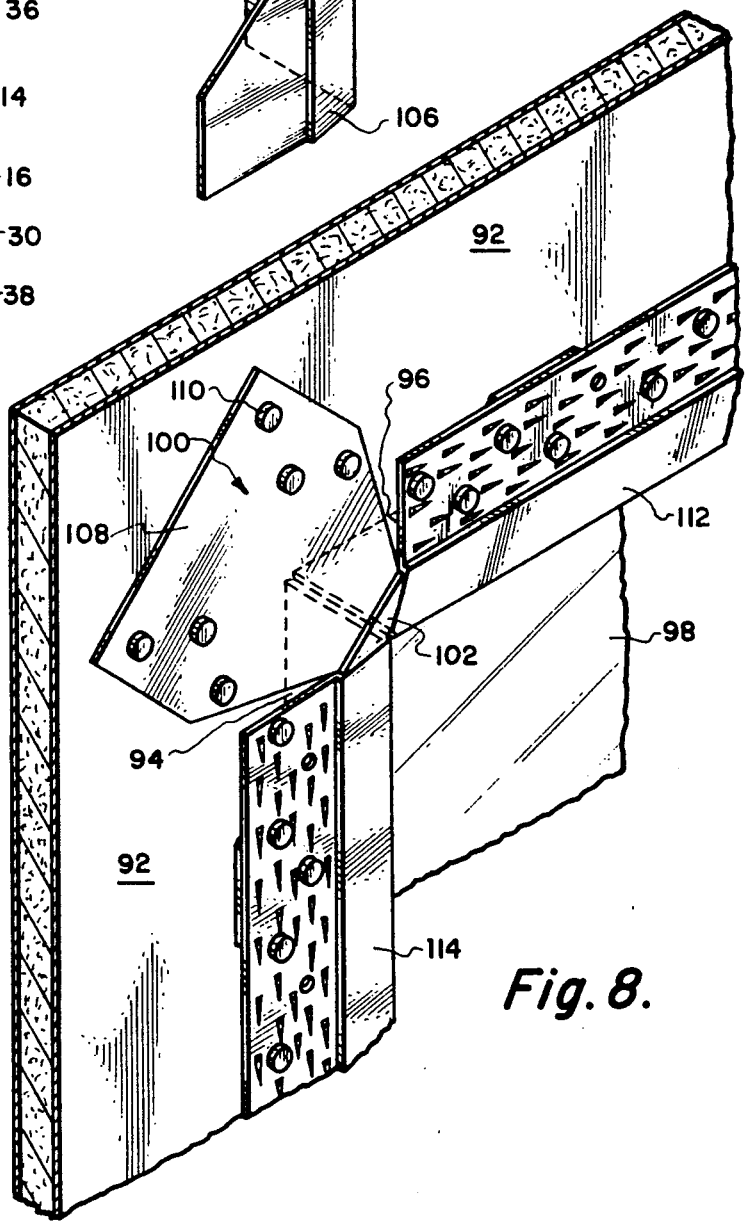
FIG. 8 is a fragmentary view of the embodiment of FIG. 7 in operative assembly with three intersecting surfaces.

Another application for the device of my invention with respect to the intersection of three surfaces is illustrated in FIGS. 7 and 8. As shown therein, surfaces 92 (exposed), 94 and 96 (hidden) intersect at an interior three-way corner adjacent a window 98, inset shelf structure, or the like.

An alternative embodiment of my invention is illustrated in FIG. 7 as interior corner capping device 100. The interior corner device 100 is similar in many respects to the capping device 66 of FIG. 5 in that it includes a central triangular portion 102 and first web means 104 extending therefrom along the line of intersection of surfaces 92 and 96, and further includes second web means 106 extending therefrom along the line of intersection of surfaces 92 and 94.

The angular relationship of the central triangular portion 102 with respect to the first and second web means 104 and 106 differs from that of the device of FIG. 5 because the device of FIG. 7 is configured for use with an interior corner rather than the exposed corner configuration of FIG. 5.

In addition, instead of the third web means extending from the central triangular portion 102 along the third line of intersection (which is formed by the intersection of surfaces 94 and 96, the third edge of the triangular portion 102 is operatively attached to or integrally formed with a substantially planar attachment flange 108. The attachment flange 108 includes attachment means 110 such a holes (for cooperative use with nails or the like), adhesive, or similar expedient, and is configured to be aligned in a confronting, parallel relationship with the surface 92.

Similarly to the assembly of FIG. 3, the first and second web means 104 and 106 are preferably overlaid with corner constructions 112 and 114, respectively, to maintain the desired operative retention and alignment thereof. Joint compound 52 is applied as described above to obtain a finished smooth corner joint.

In FIGS. 9-11, an alternative embodiment of my invention is illustrated as it might be utilized in connection with applying stucco or similar material to the exterior surface of a building. A corneraide structure 112, as shown in FIG. 11, is provided which is constructed from interwoven wire mesh or similar expedient, preferably of a sufficiently heavy gauge to retain the desired cross-sectional configuration of my invention. Apart from the materials from which it is constructed, the embodiment of FIG. 11 is functionally equivalent to that shown in FIG. 6.

The device 112 of FIG. 11 includes a substantially planar central web means 114 bounded by bead means such as elongated wire elements 116 tack-welded or otherwise operably attached to the wire mesh 114. Flange portions 118 and 120 are preferably formed from integral sections of the wire mesh 114 but in any case are operably attached to the bead means 116 and extend therefrom in directions approximately parallel to the surfaces 122 and 124, FIG. 9, onto which they will be attached.

Those surfaces 122 and 124 are preferably covered with large relatively flat sections of similar wire mesh 126 and 128, which mesh is held in operable abutting relationship with the respective surfaces 122 and 124 by attachment means 130 such as staples or the like. The flat sections of wire mesh 126 and 128 approach but do not extend to the line of intersection of the intersecting surfaces 122 and 124, so that they will not interfere in the desired alignment of the corneraide 112 thereon.

The corneraide device 112 is operably disposed over the corner, similarly to the aforementioned disposition of the device 10 over the corner in FIG. 1. Staples or a similar attachment means 130 are employed to retain the corneraide construction 112 in the desired operable alignment along the corner joint, and stucco material (not shown) is applied over the entire surface and the corners and smoothed to the desired finished surface configuration, using the bead means 116 as a guide. As the stucco hardens, it solidifies around the various wire mesh elements of the structure, including the corneraide construction 112.

Another modification to my invention permits it to be utilized in archways, curved surfaces and the like. As shown in FIGS. 12-15, a device 132, similar to the elongated member 12 of FIG. 6, is provided with periodic transverse slots 134 along its length. Each of the slots 134 preferably extend across the width of one of the flange members 136, the bead means 138 associated therewith, and a substantial distance across the central web means 140.

Figure 13:
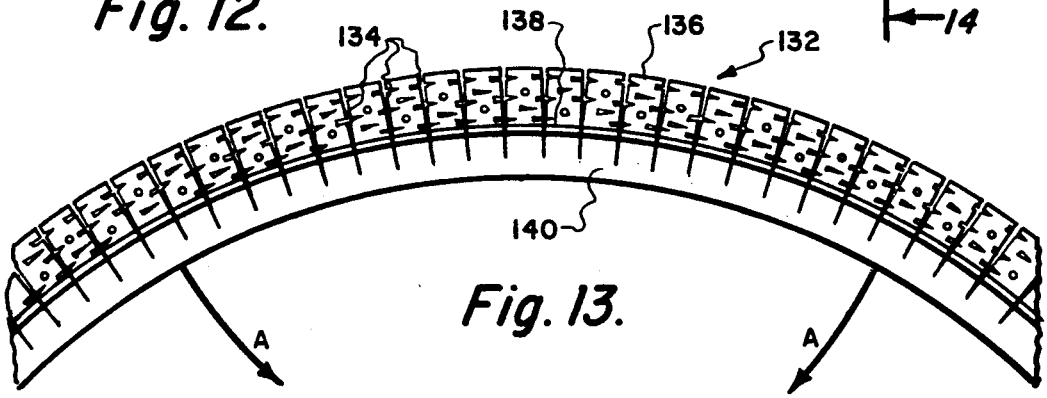
FIG. 13 is a fragmentary elevational view of the alternative embodiment of my invention of FIG. 12, which is illustrated as it might be utilized in connection with an archway or other curved surface.

The remainder of the central web means 140, the opposite bead means 142, and the opposite flange member 144 remain intact (that is, in similar condition to corresponding portions of the device of FIG. 6). As illustrated in FIG. 13, this embodiment may therefore be bent to a desired curvature by applying force in the direction of the arrows A. In such a curved configuration, the flange member 144 may readily be juxtaposed along the curved surface (not shown) of, for example, an arched pass-through or doorway, with the split flange portions 136 operably and coplanarily aligned on a relatively flat facing surface (not shown).

The central web member 140 is thereby operably disposed along the curvilinear line formed by the intersecting surfaces of the arched doorway and the relatively flat facing surface. Attachment means and coating means and methods such as those discussed above may be employed to retain and finish the joint. In the embodiment of FIG. 13, the joint compound would, in the course of providing the aforedescribed smooth finished surface, cover the gaps in the flange 136 caused by the spreading of the slots 134.

The corneraide device of my invention has been described with some particularity but the specific designs and constructions disclosed are not to be taken as delimiting the invention in that various obvious modifications will make themselves apparent to those of ordinary skill in the art, all of which will not depart from the essence of the invention and all such changes and modifications are intended to be encompassed within the appended claims.

I claim:

1. A device for finishing a joint between a first and a second surface that are not parallel to one another, including, an elongated body having a correspondingly elongated, centrally located, substantially planar web means with first and second bead means at the opposite edges of said web means, there being first and second flange means juxtaposable to the corresponding first and second surfaces, respectively, said bead means and said flange means being elongated to correspond in length with said web means.

2. The device of claim 1, in which said first and second flange means include attachment means for retaining said construction in cooperative alignment with said surfaces.

3. The device of claim 1 or claim 2, in which said first and second flange means are disposable in substantially parallel relationship with said respective surfaces, whereby coating means may be readily disposed on said flange means and formed thereon to fay said respective surfaces into the corresponding said bead means.

4. A device for forming the intersection between first, second and third surfaces, including, hub means having a substantially planar, triangular face, and first, second and third elongated web means of substantially planar configuration on respective edges of said triangular face and extending therefrom along three straight or curvilinear lines defined by the intersections of respective pairs of said first, second and third surfaces.

5. The device of claim 4, including flange means associated with the respective first, second and third web means to facilitate alignment and retention thereof adjacent said first, second and third surfaces.

6. The device of claim 5, in which said first, second and third web means are configured to provide operative alignment for corresponding first, second and third corner constructions extending along the said three straight or curvilinear lines formed by the intersection of respective pairs of the first, second and third surfaces.

7. A device for forming the intersection between first, second and third surfaces, including, hub means having a substantially planar, triangular face, and first, second and third web means of substantially planar configuration operatively secured to respective edges of said triangular face, said first and second web means extending therefrom along two of the three straight or curvilinear lines defined by the intersections of respective pairs of said first, second and third surfaces.

8. The device of claim 7, further including flange means associated with the respective first, second and third web means to facilitate alignment and retention of the device on said first, second and third surfaces.

9. The device of claim 8, in which said first and second web means are configured to provide operative alignment for corresponding first and second corner constructions extending along the said two of the three straight or curvilinear lines formed by the intersection of respective pairs of the first, second and third surfaces.

10. A device for covering corners formed by the intersection of two or more non-parallel surfaces, including a substantially planar, elongated web member having opposite first and second edges, first bead means on said first edge and second bead means on said second edge, a first attachment member operatively connected to said first bead means and a second attachment member operatively connected to said second bead means whereby said first and second attachment members are utilized to attach said device to surfaces defining said corner.

11. In a method of finishing a joint at the intersection of two or more non-parallel surfaces, the steps of:

cutting to an appropriate length an elongated member having a substantially planar central web with bead means along two parallel edges thereof and flange members associated with each of said bead means;

affixing said elongated member to said surfaces in operative alignment with said surfaces;

faying formable means onto one or more of said flange members to provide a finished surface which smoothly tapers from the corresponding of said two or more surfaces to the corresponding of said bead means, said central web permitting said faying to be accomplished with negligible disposition of said formable means on other of said flange members.

12. The method of claim 11, further including the steps of faying formable means onto two or more of said flange members and cleaning any excess formable means from said substantially planar central web.

13. The method of claim 11 or claim 12 in which said flange members are in confronting parallel relationship with corresponding of said two or more surfaces.

14. In a construction for forming joints at the intersection of a first surface and a second surface not parallel to the first surface, the combination of: first and second flange means having inner edges thereon, said flange means being juxtaposed with the corresponding first and second surfaces, respectively; first and second bead means operatively attached to said inner edges of said first and second flange means; and substantially planar web means disposed between said first and second bead means and operatively attached thereto.

15. The construction of claim 14, in which said first and second flange means include attachment means for retaining said construction in cooperative alignment with the surfaces.

16. The construction of claim 14 or claim 15, in which said first and second flange means are in substantially parallel relationship with the respective surfaces, whereby formable means may be readily disposed on said flange means and formed thereon to fay the respective surfaces into the corresponding said bead means.

* * * * *